US009893465B2

(12) United States Patent
Jimenez, III et al.

(10) Patent No.: US 9,893,465 B2
(45) Date of Patent: Feb. 13, 2018

(54) SLIDING LATCH RELEASE FOR LATCHED CABLES

(71) Applicant: Dell Products L.P., Round Rock, TX (US)

(72) Inventors: Salvador D. Jimenez, III, Cedar Park, TX (US); Corey Dean Hartman, Hutto, TX (US); Bernard D. Strmiska, Round Rock, TX (US)

(73) Assignee: Dell Products L.P., Round Rock, TN (US)

( * ) Notice: Subject to any disclaimer, the term of this patent is extended or adjusted under 35 U.S.C. 154(b) by 0 days.

(21) Appl. No.: 15/018,549

(22) Filed: Feb. 8, 2016

(65) Prior Publication Data

US 2017/0229814 A1 Aug. 10, 2017

(51) Int. Cl.

| | |
|---|---|
| ***H01R 13/627*** | (2006.01) |
| ***H01R 13/635*** | (2006.01) |
| ***H01R 12/72*** | (2011.01) |

(52) U.S. Cl.

CPC ..... *H01R 13/635* (2013.01); *H01R 12/721* (2013.01)

(58) Field of Classification Search

CPC . H01R 13/6272; H01R 13/6275; H01R 24/62

USPC ..... 439/354, 345, 352, 133; 361/377, 801

See application file for complete search history.

(56) References Cited

U.S. PATENT DOCUMENTS

| | | | | |
|---|---|---|---|---|
| 5,967,633 | A * | 10/1999 | Jung | G06F 1/181 292/107 |
| 6,447,170 | B1 * | 9/2002 | Takahashi | H01R 13/6273 385/53 |
| 6,769,927 | B2 * | 8/2004 | Brewer | H01R 12/721 439/328 |
| 6,881,089 | B1 * | 4/2005 | Yang | H01R 12/7058 361/801 |
| 7,473,124 | B1 * | 1/2009 | Briant | H01R 13/6275 439/352 |
| 7,517,241 | B2 * | 4/2009 | Gundlach | H01R 13/6335 439/344 |
| 7,540,755 | B1 * | 6/2009 | Wu | H01R 13/6275 439/352 |
| 9,197,015 | B2 * | 11/2015 | Tanaka | H01R 13/639 |
| 2007/0077806 | A1 * | 4/2007 | Martin | H01R 13/501 439/344 |
| 2010/0087084 | A1 * | 4/2010 | George | H01R 13/6275 439/352 |
| 2012/0218720 | A1 * | 8/2012 | Wu | H01R 13/6275 361/740 |

(Continued)

*Primary Examiner* — Abdullah Riyam
*Assistant Examiner* — Thang Nguyen
(74) *Attorney, Agent, or Firm* — Baker Botts L.L.P.

(57) ABSTRACT

A sliding latch release mechanism for a latched cable connector. The sliding latch release mechanism includes a fixed portion which is configured to fit securely around a latched cable connector, the latched cable connector having a latch release mechanism. The sliding latch release further includes a slideable portion which is housed within the fixed portion and is configured to move within a slot on the fixed portion. When slid back and forth, the slideable portion of the latch release mechanism engages the latch of the latched cable connector and releases the latch so the latched cable may be unplugged.

14 Claims, 5 Drawing Sheets

(56) References Cited

U.S. PATENT DOCUMENTS

2013/0330957 A1* 12/2013 Haley ..... G02B 6/3825
439/352

* cited by examiner

SLIDING LATCH RELEASE FOR LATCHED CABLES

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND

Field of the Disclosure

This disclosure relates generally to information handling systems and more particularly to a sliding latch release mechanism for latched cable connectors.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Many instances of information handling systems are installed in server chassis, such as in data centers. Examples of a chassis include a rack chassis or a tower chassis. The chassis generally includes risers that serve as connection points for Peripheral Component Interconnect (PCI) cards.

PCI cards are used to connect peripheral devices such as modems, sound cards, or other hardware devices to the information handling system. By way of non-limiting example, a PCI card may include a Power Edge RAID Controller (PERC controller) or PCI Solid State Drive (SSD) controller. Typical peripheral devices connect to PCI cards via a latch release cable, where a user must have access to the latch in order to remove the cable.

BRIEF SUMMARY

In one aspect, a disclosed sliding latch release mechanism includes a fixed outer shell portion which surrounds a latch cable connector or a bank of latched cable connectors. The sliding latch release mechanism further includes a slideable portion which is housed within and connected to the fixed outer portion and moves within a preset track created by a slot in the fixed outer portion.

In certain embodiments, the sliding latch release has a geometry on its inner surface so that it directly contacts the latch of an industry standard cable connector. By way of non-limiting example, such industry standard connectors may include a Mini Serial Attached SCSI High Density (SAS HD) or Serial AT Attachment (SATA) latch connector.

In particular embodiments, the slideable portion of the sliding latch release includes channels on the inner portion that allow it to fit and slide along the overmold of industry standard cable connectors.

In particular embodiments, the slideable portion of the sliding latch release has an outer geometry that is symmetrical around a center point and can therefore be accessed from any side or angle.

In particular embodiments, the sliding latch release can include a spring element that returns the slideable portion to its original position after it is used to disengage the latch of a latched cable connector.

BRIEF DESCRIPTION OF THE SEVERAL VIEWS OF THE DRAWINGS

For a more complete understanding of the present invention and its features and advantages, reference is now made to the following description, taken in conjunction with the accompanying drawings, in which.

DETAILED DESCRIPTION

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a Personal Digital Assistant (PDA), a consumer electronic device, a network storage device, or another suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and flash memory (SSD); as well as communications media such wires, optical fibers, microwaves, radio waves, and other electromagnetic or optical carriers; or any combination of the foregoing.

Particular embodiments of an information handling system and the disclosed subject matter are best understood by reference to FIGS. 1, 2A, 2B, 3, 4A, 4B, and 5 wherein like numbers are used to indicate like and corresponding parts.

Figure 1:
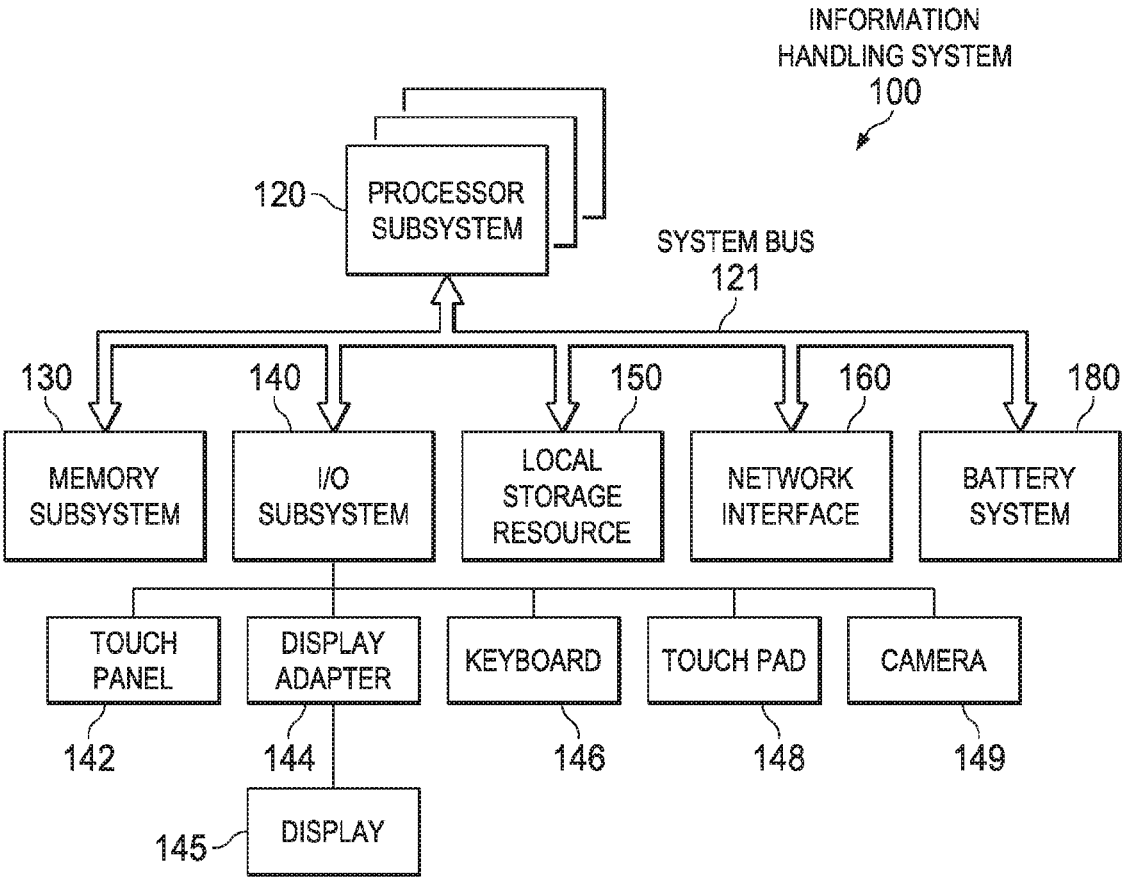
FIG. 1 is a block diagram of selected elements of an embodiment of an information handling system.

Turning now to the drawings, FIG. 1 illustrates a block diagram depicting selected elements of an embodiment of information handling system 100. In various embodiments, information handling system 100 may represent different types of portable devices.

As shown in FIG. 1, components of information handling system 100 may include, but are not limited to, processor subsystem 120, which may comprise one or more processors, and system bus 121 that communicatively couples various system components to processor subsystem 120 including, for example, a memory subsystem 130, an I/O subsystem 140, local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

Figure 2A:
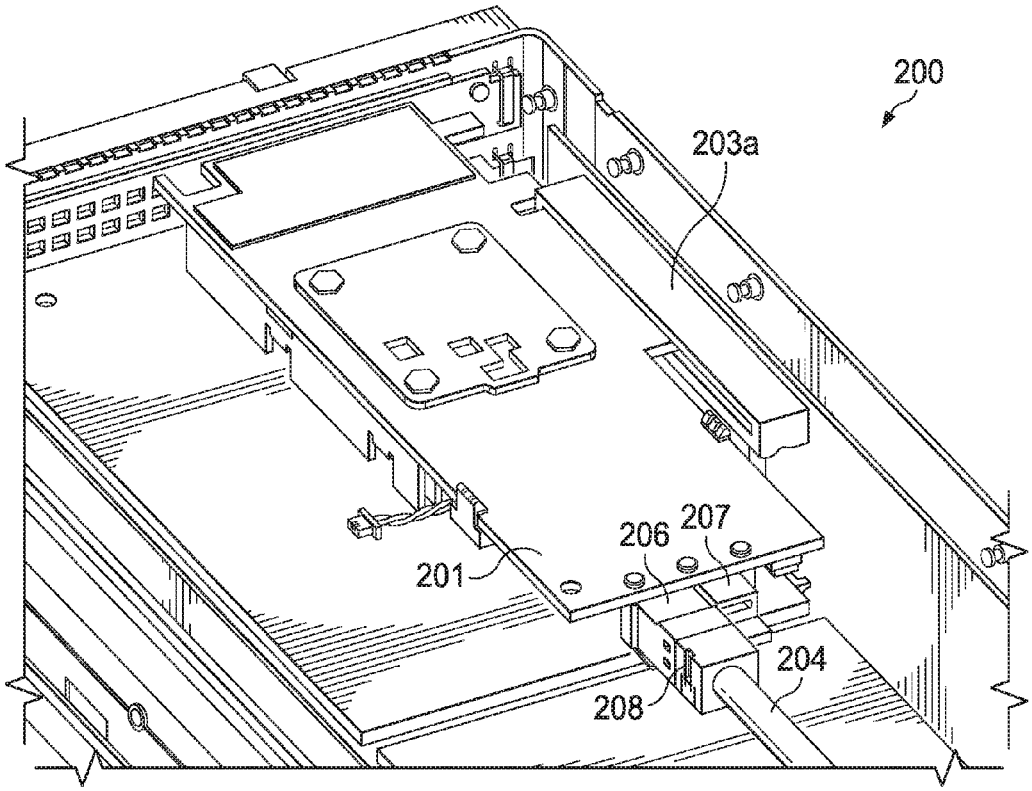
FIGS. 2A and 2B are perspective views of an installation in a rack chassis of PCI cards in different orientations.
Figure 2B:
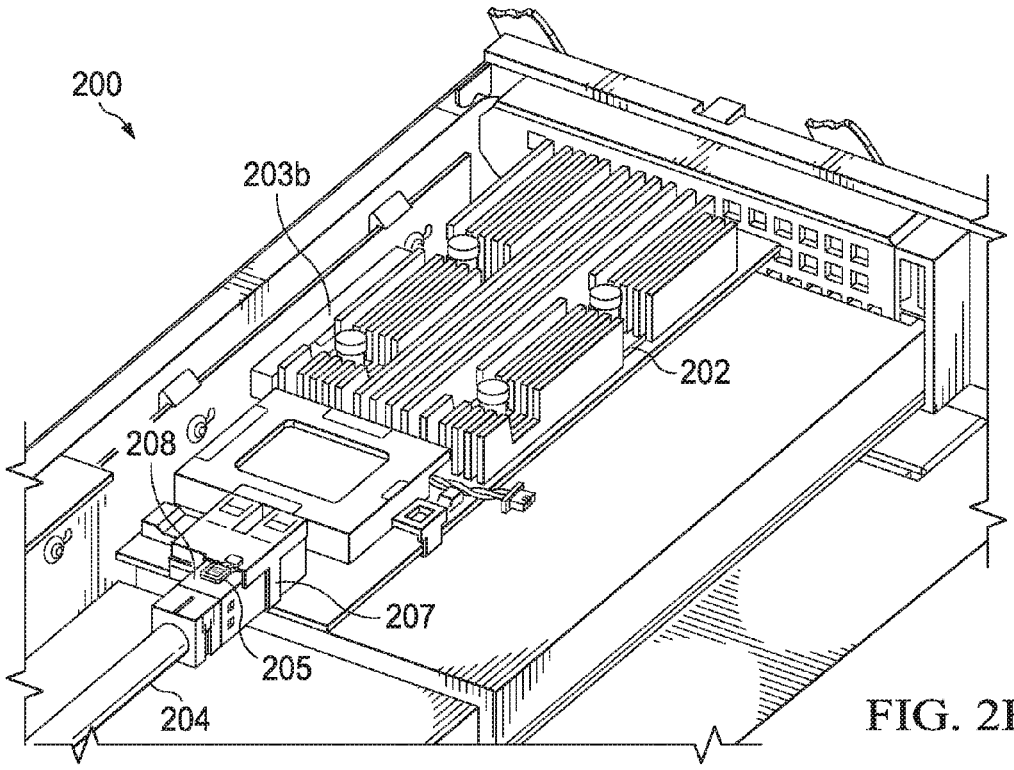

Referring now to FIGS. 2A and 2B, perspective views of selected elements of an embodiment of a rack chassis 200 are presented. As noted previously, the rack chassis used in rack domains generally include connection points for PCI cards 201 and 202, which are used to connect peripheral devices such as modems, sound cards, or other hardware devices to the information handling system. By way of non-limiting example, a rack chassis may include risers 203*a* and 203*b* that each serve as a connection point for a PCI card. Depending on the location of a riser 203, a connected PCI card may be oriented so that it is to the left or to the right of a riser 203. As shown in FIG. 2A, PCI card 201 is located in an orientation to the left of the riser 203*a*. Alternatively, as shown in FIG. 2B, the PCI card 202 is located in an orientation to the right of the riser 203*b*.

As shown in FIGS. 2A and 2B, in order to connect a PCI card to a peripheral device, a cable 204 from the peripheral device is typically connected to the PCI card 201/202. The cables have a latch cable connector 208 that plugs into cable input point 207 of the PCI card 201/202. The connector 208 generally includes a latch 205 that secures the latch cable connector 208 in the cable input point 207. The latch 205 can be unlatched by pressing down and disengaging the latch 205 in order to remove the cable 204 from the PCI card. The latch 205 is located on one side of the latch cable connector 208 and the orientation of the latch 205 depends on the orientation of the cable input point 207 of the PCI card into which the latch cable connector 208 is connected. The accessibility of the latch 205 depends on the orientation of the PCI card. For example, as shown in FIGS. 2A and 2B, the latch 205 on the latch cable connector 208 is oriented towards the top of the PCI cards 201/202. As shown in FIG. 2A, because PCI card 201 is oriented to the right of a riser 203, it is oriented "upside down" and the latch 205 is located under the latch cable connector 208 against the chassis components and is not visible. In this orientation, there is relatively little access for a user's finger to reach and unlatch the cable from the cable input point 207. On the other hand, as shown in FIG. 2B, because PCI card 202 is oriented to the right of a riser, the latch 205 of the latch cable connector 208 can be easily accessed by the fingers of a user in order to release the cable. Although PCI cards and particular connectors are illustrated, this problem extends to cards of other architectures and to other types of connectors.

As will be described in further detail, the present disclosure includes a sliding latch release device that can be connected to a latch cable connector that provides improved ability to release a latch where the orientation of the cable creates limited access to the release latch.

Particular embodiments of the sliding latch release are best understood by reference to FIGS. 3, 4A, 4B, and 5.

Figure 3:
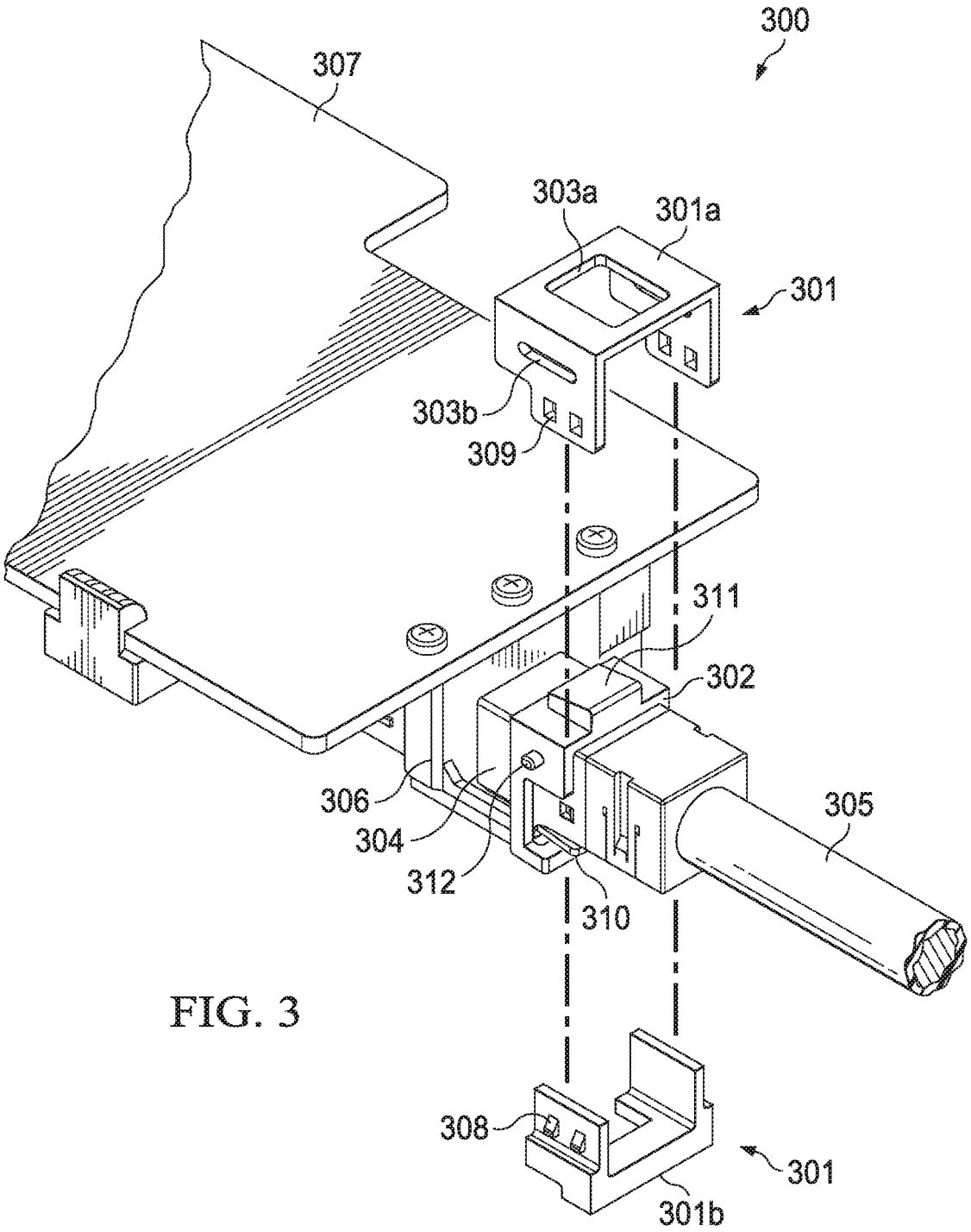
FIG. 3 is a perspective view of the disassembled parts of a sliding latch release.

Referring now to FIG. 3, a perspective view of selected elements of an embodiment of a disassembled sliding latch release 300 is presented. The sliding latch release 300 is coupled to a latch cable connector 304 of a cable 305 that plugs into a cable input point 306 of a card 307, such as a PCI card as illustrated in FIGS. 2A and 2B. As shown, sliding latch release 300 consists of a fixed portion 301 which may consist of two pieces, an upper piece 301*a* and a lower piece 301*b*. The upper 301*a* and lower 301*b* pieces may be coupled together by connecting the tabs 308 of the lower piece 301*b* with the corresponding holes 309 of the upper piece 301*a*. Once coupled together, the upper 301*a* and lower 301*b* pieces of the fixed portion 301 create a snug interference fit with the latch cable connector 304 to keep the fixed portion 301 in place. The sliding latch release 300 further consists of a slideable portion 302 which is housed within the fixed portion 301, and moves within in a limited range of motion as defined by tracks 303*a* and 303*b* in the fixed portion 301. As shown, the slideable portion 302 includes a small nub 311 on top which fits within the track 303*a* created by the fixed portion 301, and a small nub 312 on either side of the slideable portion 302 which fits within track 303*b* and thus the movement of the slideable portion 302 is confined to the parameters of tracks 303*a* and 303*b*.

This restricted movement prevents the slideable portion 302 from moving further down the latch cable connector 304.

As shown, the slideable portion 302 has an inner surface 314 with a geometry that engages with a latch 310 of a latch cable connector 304. By way of non-limiting example, the latch cable connector can be an industry standard cable connector, including a Mini SAS HD connector. However, the sliding latch release 300 may be designed to fit around any cable connector having a latch release mechanism.

Figure 4A:
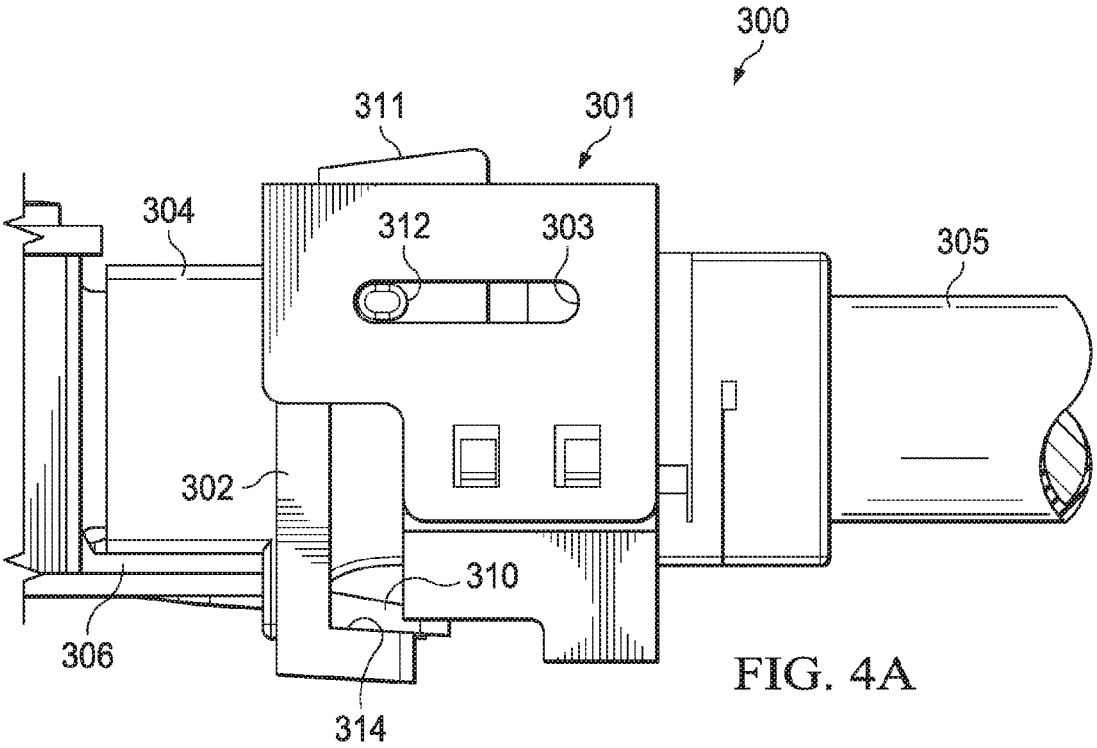
FIGS. 4A and 4B are perspective views of an embodiment of a sliding latch release attached to a PCI card cable, showing a cable in a latched and unlatched position.
Figure 4B:
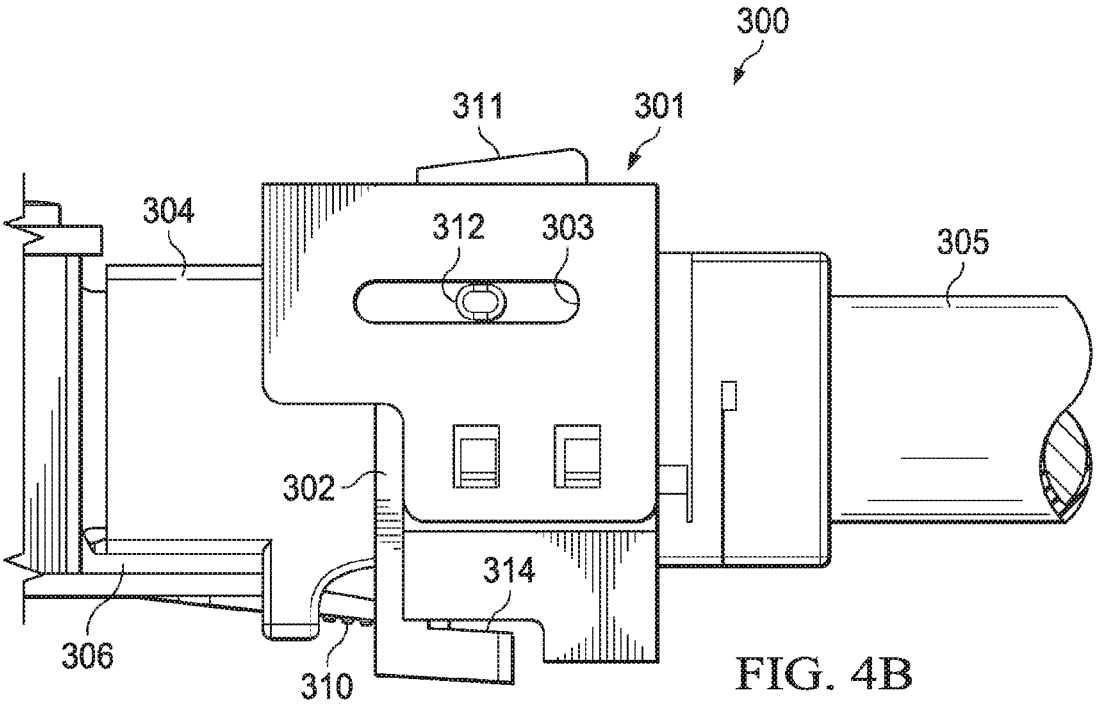

FIGS. 4A and 4B illustrate a perspective view of selected elements of an assembled embodiment of sliding latch release 300. As shown in FIG. 4A, the slideable portion 302 of the sliding latch release 300 is positioned so that the cable latch 310 is in the latched position. As shown in FIG. 4B, when the slideable portion 302 of the sliding latch release 300 is moved along tracks 303 within the fixed portion 301, the inner surface 314 of the slideable portion 302 contacts and disengages the latch 310 and disengages the latch cable connector 304 from the cable input point 306.

Figure 5:
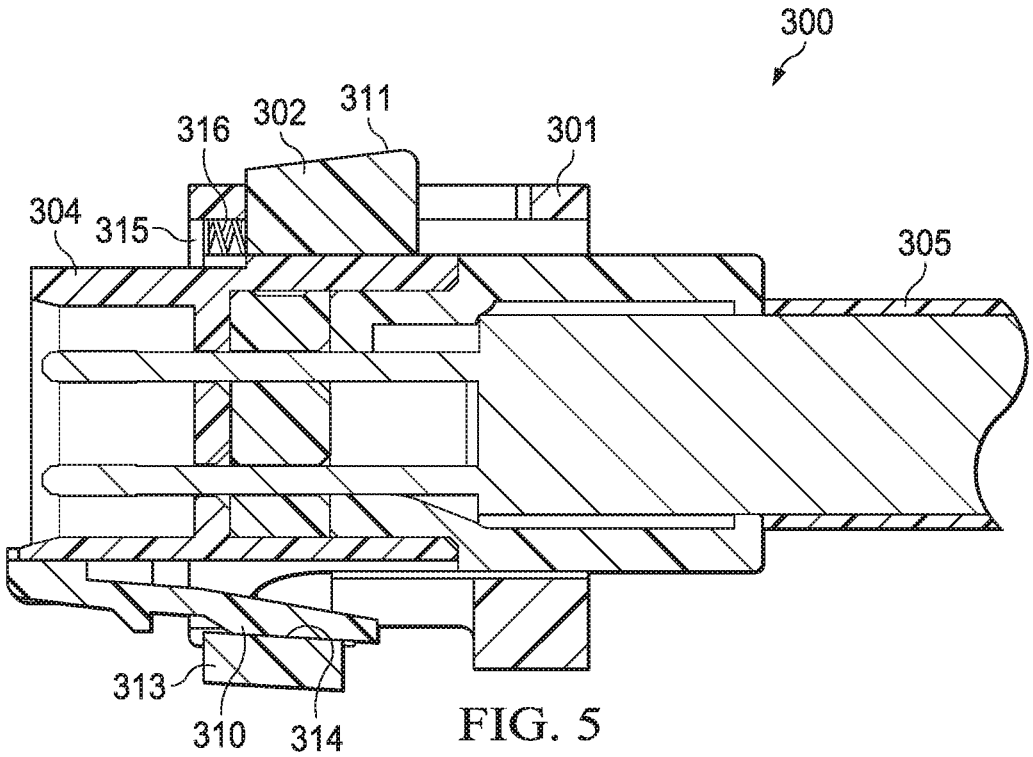
FIG. 5 is a cross sectional view of an embodiment of a sliding latch release attached to a latched cable connector.

Referring now to FIG. 5, a cross sectional view of selected elements of an embodiment of a sliding latch release 300 is presented. As shown, the slideable portion 302 of the sliding latch release 300 has outer engagement points including a nub 311 on the top of the slideable portion 302, and another nub 313 on the bottom of the slideable portion 302 so that the slideable portion 302 can be accessed regardless of orientation.

In certain embodiments, as indicated in FIG. 5, a spring mechanism 316 may be housed in the interface 315 between the slideable portion 302 and the fixed portion 301 within the sliding latch release 300. When the slideable portion 302 of the sliding latch release 300 is slid within the track from its default position, as illustrated in FIG. 4A, where the latch 310 is engaged, to the position in FIG. 4B, where the latch 310 is disengaged, the spring mechanism 316 housed at interface 315 is compressed into a loaded position. When the latch 310 has been disengaged by the slideable portion 302, and a user releases the slideable portion, the force of the spring mechanism 316 automatically returns the slideable portion 302 to its default position.

While FIGS. 3 through 5 illustrate an embodiment where there is only one latch cable connector connected to a PCI card, another embodiment of the invention includes a similar sliding latch release mechanism that fits around a bank of several latch cable connectors. In that case, there would be a single fixed portion that fits around the bank of connectors and a single slideable portion that engages with the cable latch release of each connector in the bank of connectors.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A sliding latch release mechanism for a latched cable connector comprising:

a fixed portion, the fixed portion configured to fit around one or more latched cable connectors each having a latch;

a slideable portion housed within the fixed portion, wherein the slideable portion includes nubs on either side and is configured so that the nubs move within a track in the fixed portion, so that when the slideable portion is moved within the fixed portion, the slideable portion contacts and disengages the latch and releases the latched cable connector, wherein the sliding movement of the nubs is restricted to the length of the track in both directions.

2. The sliding latch release mechanism of claim 1, wherein the fixed portion comprises an upper half and a separate lower half, wherein the upper half and lower half are coupled together by connecting tabs on the lower half and corresponding holes on the upper half, so that the lower half and upper half fit together to completely surround the one or more latched cable connectors.

3. The sliding latch release mechanism of claim 2, wherein the fixed portion has an interference fit with the latched cable connector when the upper and lower half are connected together.

4. The sliding latch release mechanism of claim 1, wherein the sliding latch release mechanism comprises a mini SAS HD latch connector, a SATA cable connector, or a PCI cable connector.

5. The sliding latch release mechanism of claim 1, wherein the slideable portion has engagement points on at least two sides so that it can be accessed regardless of orientation.

6. The sliding latch release mechanism of claim 1, wherein the sliding latch release mechanism comprises a spring mechanism, wherein the spring mechanism is housed in the interface between the upper half of the fixed portion and the slideable portion, and wherein the spring mechanism returns the slideable portion of the sliding latch release to its original position within the fixed portion after the slideable portion has disengaged the latch of the latched cable connector.

7. A method of implementing a sliding latch release mechanism for a cable connector comprising:

coupling a fixed portion to the connector, the fixed portion configured to fit around one or more latched cable connectors having a latch; and installing a slideable portion housed within the fixed portion, wherein the slideable portion includes nubs on either side and is configured so that the nubs move within a track in the fixed portion, so that when the slideable portion is moved within the fixed portion, the slideable portion contacts and disengages the latch and releases the latched cable connector, wherein the sliding movement of the nubs is restricted to the length of the track in both directions.

8. The method of claim 7, wherein the fixed portion of the sliding latch release mechanism comprises an upper half and a separate lower half, wherein the upper half and lower half are coupled together by connecting tabs on the lower half and corresponding holes on the upper half, so that the upper half and lower half fit together to completely surround the one or more latched cable connectors.

9. The method of claim 7, wherein the sliding latch release mechanism comprises a mini SAS HD latch connector, a SATA cable connector, or a PCI cable connector.

10. The method of claim 7, wherein the slideable portion of the sliding latch release mechanism has engagement points on at least two sides so that it can be accessed regardless of orientation.

11. An information handling system, comprising:

a chassis including a riser attached to the chassis;

a card connected to the riser;

a latch cable plugged into the card; and a sliding latch release mechanism surrounding the latch cable, wherein the sliding latch release mechanism comprises:

a fixed portion, the fixed portion configured to fit around one or more latched cable connectors having a latch;

a slideable portion housed within the fixed portion, wherein the slideable portion includes nubs on either side and is configured so that the nubs move within a track in the fixed portion, so that when the slideable portion is moved within the fixed portion, the slideable portion contacts and disengages the latch and releases the latched cable connector, wherein the sliding movement of the nubs is restricted to the length of the track in both directions.

12. The information handling system of claim 11, wherein the fixed portion comprises an upper half and a separate lower half, wherein the upper half and lower half are coupled together by connecting tabs on the lower half and corresponding holes on the upper half, so that the upper half and lower half fit together to completely surround the one or more latched cable connectors.

13. The information handling system of claim 11, wherein the sliding latch release mechanism comprises a mini SAS HD latch connector, a SATA cable connector, or a PCI cable connector.

14. The information handling system of claim 11, wherein the slideable portion of the sliding latch release mechanism has engagement points on at least two sides so that it can be accessed regardless of orientation.

* * * * *